US005195832A

United States Patent [19]

Fujikawa et al.

[11] Patent Number: 5,195,832

[45] Date of Patent: Mar. 23, 1993

[54] ELECTRICAL STAMP DEVICE WITH INK TEMPERATURE COMPENSATION FOR STENCIL PAPER PERFORATION

[75] Inventors: Toshihide Fujikawa; Nagoya-Shi Tetsuji Fuwa, Hashima, both of Japan

[73] Assignee: Brother Kogyo Kabushiki Kaisha, Nagoya, Japan

[21] Appl. No.: 864,349

[22] Filed: Apr. 6, 1992

[30] Foreign Application Priority Data

May 10, 1991 [JP] Japan ..... 3-105801

[51] Int. Cl.[5] ..... B41J 3/02

[52] U.S. Cl. ..... 400/120; 346/76 PH; 101/93.04; 101/128.21

[58] Field of Search ..... 101/26, 114, 117, 118, 101/119, 120, 121, 122, 125, 126, 128.21, 128.4, 142, 93.03, 93.04; 400/136, 120; 346/76 PH

[56] References Cited

U.S. PATENT DOCUMENTS

| | | | |
|---|---|---|---|
| 2,499,472 | 3/1950 | Dyal . | |
| 3,799,053 | 3/1974 | Rabelow . | |
| 4,444,808 | 4/1984 | Kikuchi et al. | 101/128.21 |
| 4,497,848 | 2/1985 | Baran | 101/128.4 |
| 4,664,542 | 5/1987 | Tsugita | 101/93.05 |
| 4,705,412 | 11/1987 | Matsumoto | 101/93.04 |
| 4,724,336 | 2/1988 | Ichikawa et al. | 101/93.04 |
| 4,845,574 | 7/1989 | Mitsushima et al. | 400/120 |
| 4,887,092 | 12/1989 | Pekruhn et al. | 346/76 PH |
| 4,893,191 | 1/1990 | Tanaka et al. | 346/76 PH |
| 4,916,486 | 4/1990 | Nakatani | 101/142 |
| 4,957,378 | 9/1990 | Shima | 400/120 |
| 4,963,884 | 10/1990 | Kiguchi et al. | 400/120 |
| 4,967,287 | 10/1990 | Nakatani | 101/114 |
| 5,006,866 | 4/1991 | Someya | 346/76 PH |
| 5,021,805 | 6/1991 | Imaizumi et al. | 346/76 PH |
| 5,023,626 | 6/1991 | Kawamura | 346/76 PH |
| 5,025,267 | 6/1991 | Schofield et al. | 400/120 |
| 5,061,565 | 10/1991 | Aókl et al. | 101/128.21 |

FOREIGN PATENT DOCUMENTS

| | | | |
|---|---|---|---|
| 0130612 | 1/1985 | European Pat. Off. . | |
| 0179362 | 10/1984 | Japan | 400/120 |
| 0048398 | 3/1985 | Japan . | |
| 0180891 | 9/1985 | Japan | 101/128.21 |
| 63-11855 | 1/1988 | Japan . | |
| 63-17074 | 1/1988 | Japan . | |
| 107403 | 11/1923 | Switzerland . | |

OTHER PUBLICATIONS

Patent Abstract of Japan "Heat-Sensitive Stencil Paper", Publication No. 60180891 (Eng. Ab. Only) Jan. 28, 1986.

*Primary Examiner*—Eugene H. Eickholt
*Attorney, Agent, or Firm*—Oliff & Berridge

[57] ABSTRACT

A stamp device is capable of selecting a current supply time for use by a thermal head in accordance with an ink temperature detected by a temperature sensor so as to control the size of perforations to be formed on a heat sensitive stencil paper by the thermal head. Therefore, the stamp device can form uniform images even when there is a variation in the viscosity of ink caused by changes in the evironmental temperature of the stamp device.

21 Claims, 14 Drawing Sheets

Fig.13B

| ITEM | INSTRUCTIONS |
|---|---|
| S1 | OBTAIN THE TEMPERATURE INFORMATION |
| S2 | LOW TEMPERTURE $T_L$? |
| S3 | SELECT THE CURRENT SUPPLY TIME $t_3$ FROM THE SUPPLY TIME COLLECTION TABLE |
| S4 | SET THE CURRENT SUPPLY TIME $t_3$ |
| S5 | NORMAL TEMPERATURE $T_M$? |
| S6 | SELECT THE CURRENT SUPPLY TIME $t_2$ FROM THE SUPPLY TIME COLLECTION TABLE |
| S7 | SET THE CURRENT SUPPLY TIME $t_2$ |
| S8 | SELECT THE CURRENT SUPPLY TIME $t_1$ FROM THE SUPPLY TIME COLLECTION TABLE |
| S9 | SET THE CURRENT SUPPLY TIME $t_1$ |

Fig.14

203A

| ENVIRONMENTAL TEMPERATURE TC | POWER SUPPLY TIME |
|---|---|
| TL ( TL < 10 °C ) | t3 |
| TM ( 10 °C ≦ TM < 25 °C ) | t2 |
| TH ( 25 °C ≦ TH ) | t1 |

ELECTRICAL STAMP DEVICE WITH INK TEMPERATURE COMPENSATION FOR STENCIL PAPER PERFORATION

CROSS-REFERENCE TO RELATED APPLICATIONS

This application is related to U.S. patent application Ser. No. 07/864,340, to Hiroshi Kawahara, entitled "Electrical Stamp Device Capable Of Displaying An Image Layout, And Which Uses A Stencil Paper", filed concurrently herewith. This application is also related to U.S. patent application Ser. No. 07/811,974 entitled "Stamp Device Employing A Heat Sensitive Stencil Paper To Be Perforated By Heat Of A Thermal Head" to Takashi Miki et al., filed Dec. 23, 1991; and U.S. patent application Ser. No. 07/812,107 entitled "Stamp Device Employing An Elongate Heat Sensitive Stencil Paper" to Teruo Imamaki et al., filed Dec. 23, 1991. The disclosures of U.S. patent application Ser. Nos. 07/811,974 and 07/812,107 are incorporated herein by reference.

BACKGROUND OF THE INVENTION

1. Field of the Invention

The present invention relates to stamp devices employing stencil paper such as heat sensitive stencil paper capable of being perforated by infrared irradiation or heat provided by a thermal head, and more particularly to compact portable stamp devices which can be used in varying environmental conditions.

2. Description of Related Art

A compact portable stamp device which employs stencil paper having a perforated pattern of characters, figures, etc. formed by using a pencil or a ball-point pen is known. For example, FIG. 17 shows a stamp device disclosed in U.S. Pat. No. 3,799,053. The construction of the stamp device will be explained with reference to FIG. 17.

The stamp device includes a table 100, a bottle grip 101, an inking unit 102, a compression spring 103 and a syphon tube 105. The bottle grip 101 is flexible and is used like a squeeze bottle. That is, the inside of the bottle grip 101 is hollow, with liquid ink stored therein.

Compression spring 103 is disposed between bottle grip 101 and table 100. Compression spring 103 presses bottle grip 101 and table 100 so as to part them from each other. Therefore, inking unit 102 connected to bottle grip 101 is usually arranged within the confines of table 100. Therefore, even if the table 100 is placed on a medium to be printed, such as ordinary plain paper, the medium does not receive a printing image.

Table 100 is made from a metal plate, such as aluminum, so as to be easily cleaned. The four sides of the metal plate are bent downwardly so that the lower side of table 100 is open. An aperture is formed at the center of the upper side of table 100. Bottle grip 101 and the inking unit 102 are connected to each other through the aperture.

An ink pad is disposed inside of inking unit 102, such that the liquid ink stored in bottle grip 101 will be supplied to the ink pad. A stencil paper 104 having a perforation pattern of characters, figures, etc. formed by using a pencil a ball-point pen or other pointed instruments is detachably arranged under the ink pad.

Syphon tube 105 is provided in bottle grip 105 and supplies the ink stored in bottle grip 101 to the ink pad of inking unit 102.

Next, the operation of the stamp device will be explained with reference to FIG. 17. In the stamp device, a user draws characters, figures, etc. on stencil paper 104 by using a pencil or a ball-point pen. Stencil paper 104 is then perforated based on the drawn pattern. Next, the user installs stencil paper 104 under inking unit 102 and places the stamp device on a medium to be printed, such as ordinary paper. The user grasps bottle grip 101 and pushes it downward. This causes inking unit 102 to descend against the bias of compression spring 103, so that inking unit 102 is pressed against the ordinary paper through stencil paper 104. Ink from the ink pad of inking unit 102 then passes through the perforations of stencil paper 104 so that the ordinary paper is printed with the ink in the pattern formed on stencil paper 104. If the user stops pressing down on bottle grip 101, the stamp device returns to the former state by expansion of compression spring 103 so that the inking unit 102 parts from the ordinary paper, completing the printing operation.

If after a plurality of print operations, the ink of the ink pad is depleted, the user firmly grips and squeezes flexible bottle grip 101. This causes the ink in bottle grip 101 to pass through syphon tube 105 and be supplied to the ink pad of inking unit 102.

Heat sensitive stencil paper which can be perforated by infrared irradiation or heat provided by a thermal head is also known. A typical example of such heat sensitive stencil paper is formed by bonding a thermoplastic film and a porous thin paper to each other by use of an adhesive. FIG. 18 shows a compact portable stamp device employing such heat sensitive stencil paper disclosed in Japanese Laid-Open Patent No. Sho 63-17074. Heat sensitive paper is also disclosed in the above-incorporated U.S. patent application Ser. No. 07/812,107.

The stamp device of FIG. 18 employs a mimeograph printing plate 106. Mimeograph printing plate 106 consists of perforated heat sensitive stencil paper 110, an ink impermeable cover sheet 112 and a frame 108. The frame 108 has a central aperture. Heat sensitive stencil paper 110 to be perforated by infrared irradiation or heat from a thermal head is installed under frame 108. Ink impermeable cover sheet 112 is installed on the other side of frame 108. The mimeograph printing plate 106 can be filled with ink between heat sensitive stencil paper 110 and ink impermeable cover sheet 112. The main body 130 of the stamp device comprises a base 114, a cushion layer 116, a cohesive layer 118 and a grip member 120 fixed to base 114.

Base 114 is a rigid member such as synthetic resin or wood. Cushion layer 116 is a foam body such as urethane or sponge, and has a hexahedron shape. Cushion layer 116 is bonded under the base 114 by an adhesive.

Cohesive layer 118 is a gel silicon rubber, a rubber with moderate adhesion such as monomer residual polyurethane rubber, or other rubber-like materials. Cohesive layer 118 can be adhered to cover sheet 112 of mimeograph printing plate 1 06. The base shape or base area of cohesive layer 118 is almost the same as that of the aperture formed in the center of frame 108. Cohesive layer 118 is bonded to cushion layer 116 by adhesive.

Next, the operation of the stamp device will be explained with reference to FIG. 18. Heat sensitive stencil paper 110 of mimeograph printing plate 106 is perforated by infrared irradiation or heat provided by a thermal head (not shown) so as to have a perforation pattern of characters and figures therein. Next, the user places ink on heat sensitive stencil paper 110 while cover sheet 112 is turned up from frame 108 (as shown in FIG. 18). Because a porous thin paper layer of the heat sensitive stencil paper 110 faces the inside of frame 108, the ink is maintained within frame 8 by the porous thin paper layer. Next, the user closes cover sheet 112. The user then places main body 130 and mimeograph printing plate 106 together such that the cohesive layer 118 of main body 130 is attached into the aperture of frame 108. The user then places main body 130 to which mimeograph printing plate 106 is fixed, onto the medium to be printed. Next, the user grasps grip member 120 and pushes it downward. The ink between heat sensitive stencil paper 110 and cover sheet 112 is pressed through the porous thin paper layer of sheet 110, and passes through each perforation in heat sensitive stencil paper 110 so that the ink adheres onto the medium to be printed.

If after a plurality of print operations the ink between heat sensitive stencil paper 110 and cover sheet 112 is depleted, the user removes main body 130 from mimeograph printing plate 106, and places additional ink onto heat sensitive stencil paper 110 while cover sheet 112 is turned up from frame 108. Afterwards, the user closes the cover sheet 112 as described above, and places main body 130 and mimeograph printing plate 106 together such that cohesive layer 118 of main body 130 is attached into the aperture of frame 108. Thus, the print operation can be executed again.

In the above-described conventional stamp device, the viscosity of the ink is dependent on an environmental temperature of the stamp device. (Specifically, the temperature of ink in the stamp device which is usually about the same as the temperature of the environment in which the stamp device is used.) Therefore, there is a problem that the print quality is influenced directly by changes in environmental temperature.

This problem will be explained with reference to FIG. 9, FIG. 15 and FIG. 16. FIG. 9 shows the letter "I" printed by using a stamp device. FIG. 15 is an enlarged view showing the printing of individual spots which comprise the FIG. 9 print at a low environmental temperature. FIG. 16 is an enlarged view showing the printing of individual spots at a high environmental temperature.

When the environmental temperature is low, the viscosity of the ink becomes high (i.e., the ink thickens). Therefore, the high viscosity of the ink produces an ink printing state as illustrated in FIG. 15. The individual spots are spaced far apart from each other resulting in less clear characters. When the environmental temperature is high, the viscosity of the ink becomes low (i.e., the ink runs more easily). Therefore, the low viscosity of the ink causes the ink spots to overlap at, for example, overlapped portion 62 as shown in FIG. 16. This also adversely affects the resulting character.

As described above, there is a problem in that printing reproducibility is deteriorated due to the environmental temperature of and around the stamp device even if the perforations can be formed to have substantially the same diameter.

OBJECT AND SUMMARY OF THE INVENTION

It is an object of the present invention to provide a compact portable stamp device which can provide consistent printing reproducibility even when an environmental temperature of the stamp device is changed.

To achieve the above and other objects, and to overcome the shortcomings set forth above, a stamp device of the present invention comprises: stencil paper; perforating means for forming a perforation pattern of characters and images on the stencil paper; an environmental temperature detecting sensor for detecting an environmental temperature of the stamp device and for outputting environmental temperature information; and control means for controlling a size of the perforations which are formed on the stencil paper by the perforating means according to the environmental temperature information input from the temperature detecting sensor. Preferably, the stencil paper is the above-described heat sensitive stencil paper, and the perforating means is a thermal head.

According to the stamp device of the present invention, the environmental temperature detecting means detects the environmental temperature of the stamp device and outputs the environmental temperature information to the control means. Based upon the environmental temperature information output by the environmental temperature detecting means, the control means controls the size of the perforations to be formed on the heat sensitive stencil paper by the perforating means. That is, the environmental temperature detecting means detects the environmental temperature of the stamp device, and according to the environmental temperature, the size of the perforations is changed. This enables the amount of ink passing through the perforations of the stencil paper to be adjusted.

As is apparent from the above description, because the stamp device of the present invention can form perforations according to the environmental temperature, even when the environmental temperature is changed from a normal environmental temperature range, the proper quantity of ink is adhered to the printing paper, so that high quality printing is executed.

BRIEF DESCRIPTION OF THE DRAWINGS

A preferred embodiment of the present invention will be described in detail with reference to the following drawings in which like reference numerals refer to like elements, and wherein:

FIGS. 13A and 13B are a flowchart and table explaining a control program of the described embodiment of the invention;

FIG. 14 illustrates a supply time correction table usable in the described embodiment of the invention;

DETAILED DESCRIPTION OF THE PREFERRED EMBODIMENT

Figure 1A:
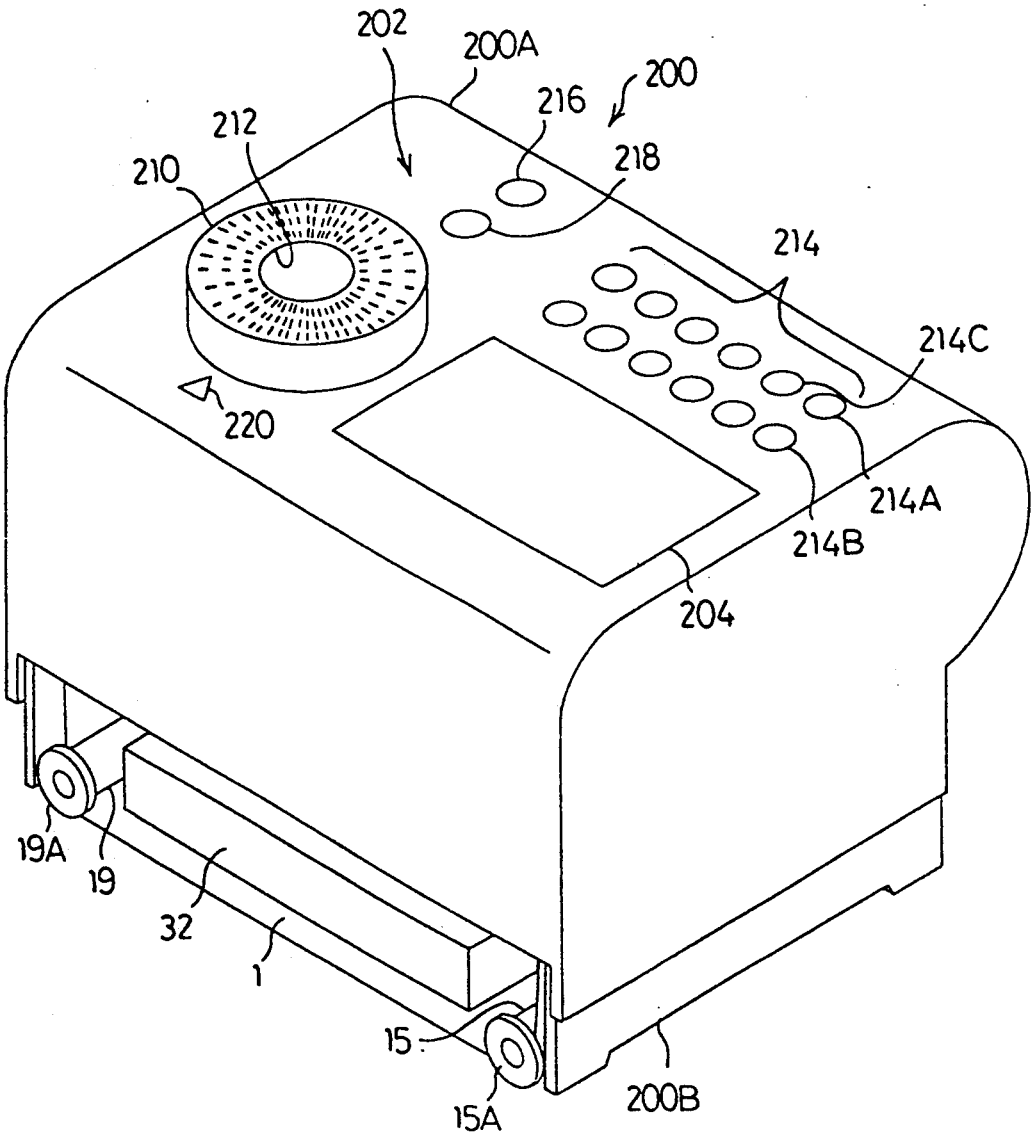
FIG. 1A is a perspective view of one embodiment of a stamp device according to the present invention.
Figure 1B:
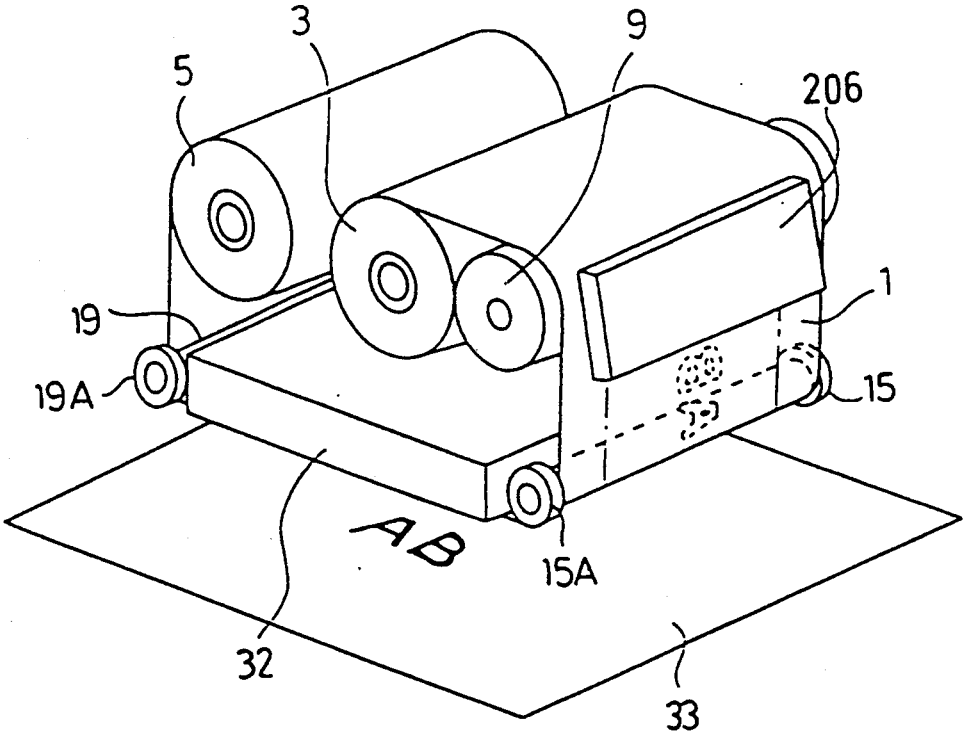
FIG. 1B is a perspective view of the inner mechanisms of the stamp device of FIG. 1A.

A preferred embodiment of the present invention will now be described with reference to the drawings.

First, the construction of a stamp device 200 of one preferred embodiment will be explained with reference to FIG. 1A, FIG. 1B, FIG. 2 and FIG. 3. The description of stamp device 200 is provided with respect to the device exterior portion shown in FIG. 1A and the interior portion shown in FIG. IB. First, the exterior portion of the stamp device will be explained.

On the upper side of the device cover 200A, an input portion 202 which functions as an input means, and a display 204 which functions as a display means are provided. The input portion 202 includes a dial 210 for selecting characters to be input, a button 212 and various keys 214. Additionally, a power switch 216 and a perforation starting key 218 are also provided on the upper side of the device cover 200A.

Dial 210 is rotatable. The hiragana characters, the English alphabet characters, figures, and symbols, for example, are printed on dial 210. As described later, one of the hiragana, the alphabet, figures, and symbols adjacent to a triangular mark 220 can be input to the RAM 209 of the stamp device.

Button 212 is provided at a central portion of dial 210. When a user pushes button 212, one of the characters, figures or symbols which is selected by dial 210 is defined, and stored in RAM 209 of the stamp device to be described later.

The various keys 214 are function keys such as a conversion key 214A, a shift key 214B, a cursor move key 214C, etc. Conversion key 214A is used for converting the hiragana character selected by dial 210 and stored in the RAM 209, into the corresponding chinese character. Shift key 214B is used for selecting whether the selected character is printed as a capital or lower case letter. Cursor move key 214C is used for moving a cursor on display 204. Other function keys can also be provided for changing the layout or the format. Power switch 216 is used for turning stamp device 200 on or off.

Display 204 is disposed adjacent to dial 210 and the various keys 214. Display 204 displays the characters, figures and symbols which have been selected by dial 210 and stored in RAM 209 of the stamp device by pressing button 212, a format information button or a message button. Display 204 is, for example, a liquid crystal display or a plasma display.

The device cover 200A on which the above-described elements are located is made from, for example, resin materials. Device cover 200A can cover the interior of the device, to be described below. Thus, the device cover 200A is a hexahedron having an open base side.

Next, the interior of the stamp device 200 will be described with reference to FIG. IB. The interior of the stamp device 200 includes a supply roller 3, a take-up roller 5, a thermal head 206 for forming images, a platen 9, a guide roll 15, a take-up guide roll 19, an ink pad 32, a stepping motor 205 (see FIG. 12), a temperature sensor 207 (see FIG. 2) and inner case (or frame) 200B. The supply roller 3, the take-up roller 5, the thermal head 206, the platen 9, the guide roll 15, the take-up guide roll 19, the stepping motor 205 and the temperature sensor 207 are supported by the inner frame 200B.

Figure 3:
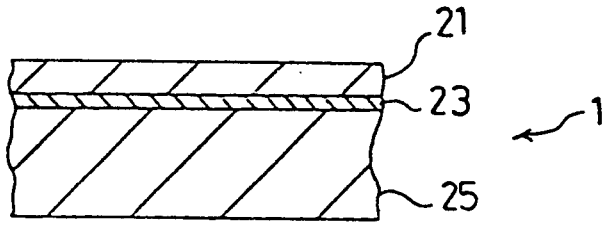
FIG. 3 is a cross-sectional view of a heat sensitive stencil paper for use with the preferred embodiment of the invention.

As shown in FIG. 3, a heat sensitive stencil paper (hereafter referred to as stencil paper) is used in stamp device 200. Stencil paper is comprised of a thermoplastic film 21, an adhesive layer 23 and a porous carrier 25, wherein the thermoplastic film 21 and the porous carrier 25 are bonded to each other through the adhesive layer 23. Stencil paper 1 is an elongated web. In the presently described embodiment, thermoplastic film 21 is a polyethylene terephthalate film (hereafter referred to as a "PET film") having a thickness of 2 μm. However, the film may be polypropylene, a vinylidene chloride-vinyl chloride copolymer or the like.

The thickness of the PET film is preferably 1–4 μm. If the thickness is less than 1 μm, a manufacturing cost becomes high, and a strength becomes too low. In contrast, if the thickness is more than 4 μm, it becomes difficult to perforate the film with common thermal heads having a rated power of about 1 mJ/dot.

Porous carrier 25 in this preferred embodiment is formed of porous thin paper made of mainly natural fiber such as Manila hemp, kozo and mitzumata, synthetic fiber such as PET, polyvinyl alcohol, polyacrylonitrile and polypropylene, or semisynthetic fiber such as rayon. Porous carrier 25 is mainly used for supplementing the strength of the perforated thermoplastic film 21. Therefore, the thickness of porous carrier 25 is preferably 40 μm–60 μm, in the present embodiment, 50 μm. The web-like stencil paper 1 is wound up on supply roll 3. The stencil paper 1 wound on supply roll 3 is fed across platen 9 and guide roll 15 on a supply side of pad 32, and is fed under ink pad 32 to be rolled up in take-up roll 5 via a take-up guide roll 19 on the take-up side of pad 32.

Platen 9 has a cylindrical shape and has a somewhat flexible surface, such as silicon rubber. Platen 9 is supported so as to rotate in the direction indicated by arrow A in FIG. 2 by stepping motor 205. By rotating platen 9, stencil paper 1 is unwound from supply roll 3 and fed along a portion of the surface of platen 9.

Generally, thermal head 206 used for the perforated image forming operation on sheet 1 is similar to that used in conventional heat transcript printers. Thermal head 206 is disposed so as to be closely adjacent to platen 9 with stencil paper 1 therebetween.

Figure 5:
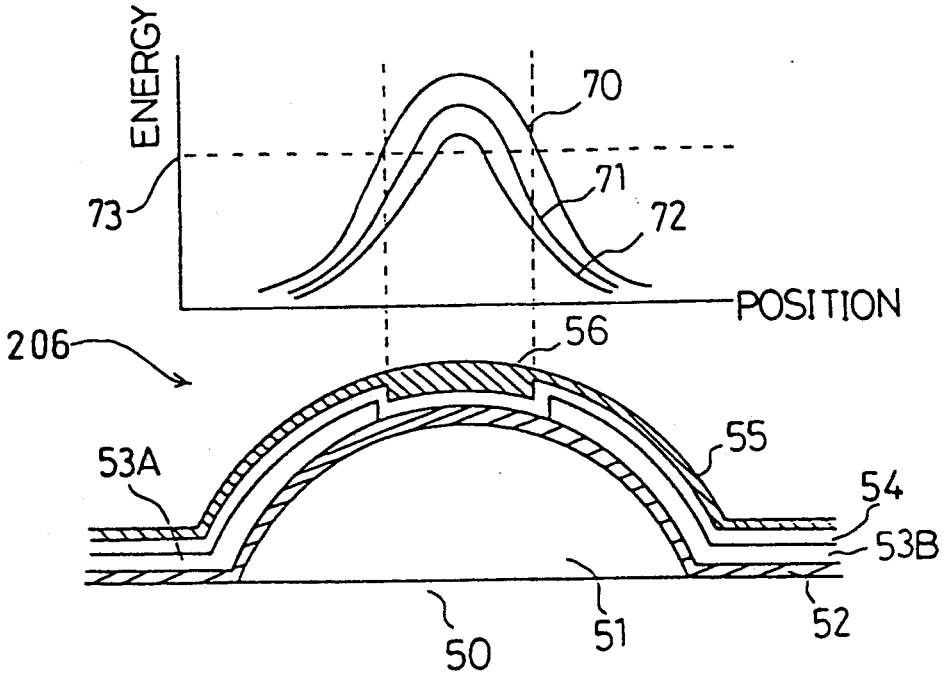
FIG. 5 is a cross-sectional view of the thermal head, and graphically shows a relationship between energy and generated heat distributed across a heating element of the thermal head.

As depicted in FIG. 5, for the purpose of enhancing contact between an aluminum base 50 of thermal head 206 and stencil paper the thermal head 206 is provided with a projecting glaze layer 51, on which is superposed a heat resistor layer 52. Conductors 53A and 53B are disposed on the heat resistor layer 52. An antioxidant film 54 and a protective film 55 are provided on the conductors 53A and 53B so that conductors 53A and 53B are covered. A thicker central portion of protective film 55 forms a heat generating portion 56. Heat generating portion 56 generates heat according to the energization of heat resistor layer 52. When heat generating portion 56 generates heat while placed in contact with thermoplastic film 21 of stencil paper 1, the thermoplastic film 21 is perforated by the heat.

Supply side guide roll 15 and take-up side guide roll 19 are cylindrical, and are made from resins such as polypropylene, polyacetal and polyethylene. According to the width of stencil paper collars 15A and 19A are formed on both ends of guide roll 15 and guide roll 19, respectively. When stencil paper 1 is fed along the peripheries of supply side guide roll 15 and take-up side guide roll 19, the stencil paper 1 is maintained in place laterally between collars 15A and 19A. Therefore, collars 15A and 19A guide stencil paper 1 such that stencil paper 1 does not meander while being fed over the peripheries of supply side guide roll 15 and take-up side guide roll 19.

Ink pad 32 is also formed, for example, to have a hexahedron shape. The lower side of the ink pad is open. The ink pad 32 includes an outer body 31 made from a metal which does not corrode, such as stainless, or resins such as vinyl chloride, polypropylene, polyethylene, polyacetal and polyethylene terephthalate. An ink storing layer 27 which holds ink is located inside body 31 of ink pad 32.

Temperature sensor 207 is disposed on a periphery of ink pad 32, for example, above the left side of ink pad 32 so as to detect an environmental temperature of ink pad 32.

Figure 2:
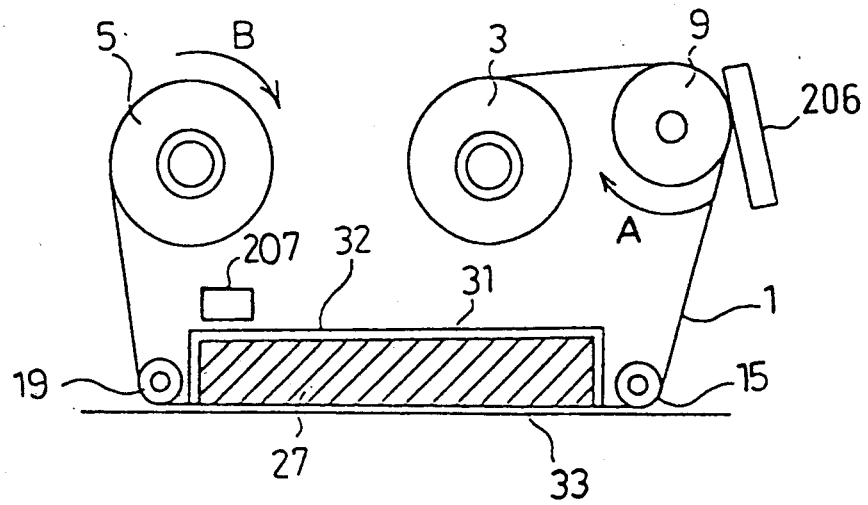
FIG. 2 is a cross-sectional view of the inner mechanisms of the stamp device of FIG. 1B.
Figure 12:
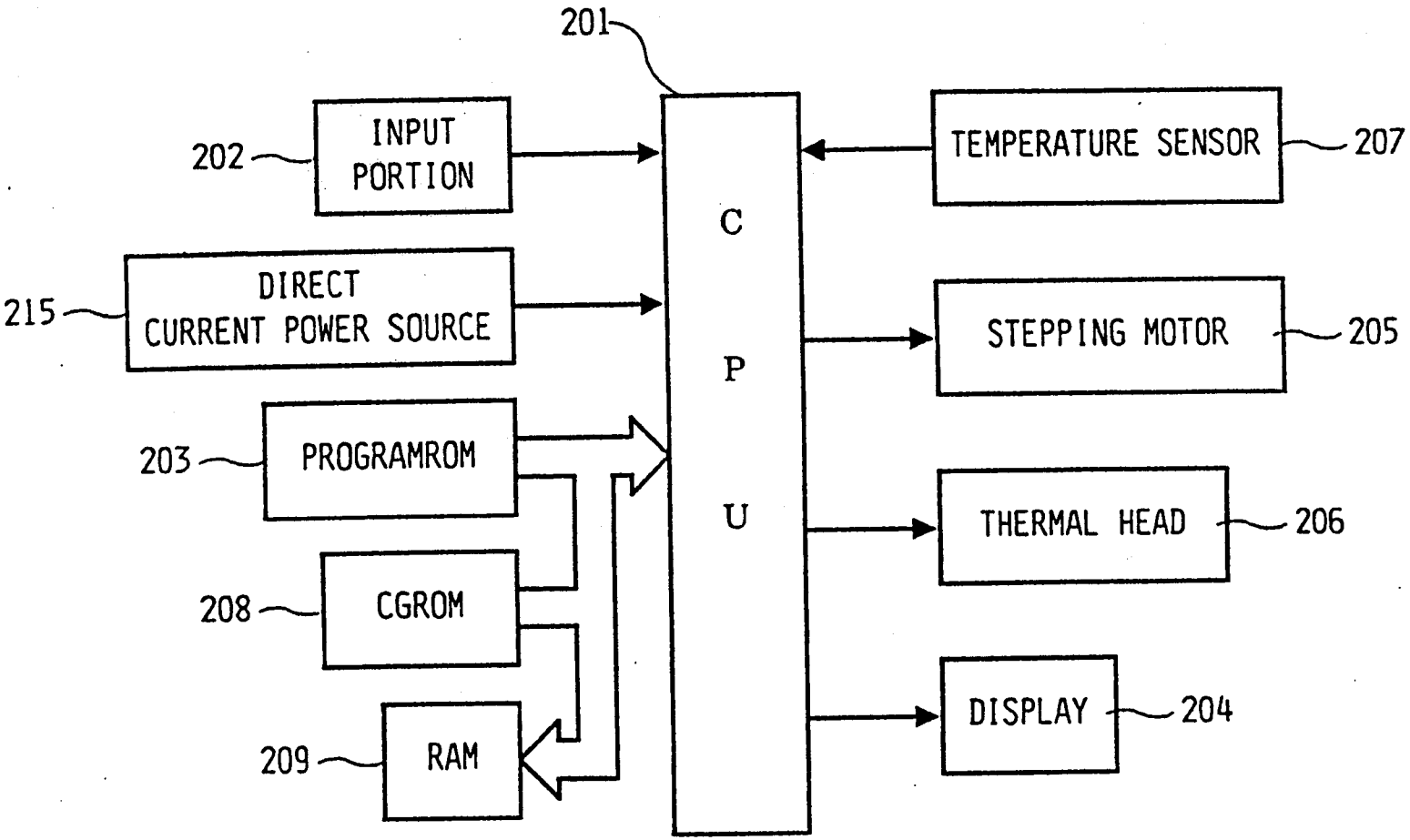
FIG. 12 is a block diagram showing a control portion of the described embodiment of the invention.

Next, the construction of the stamp device of the present embodiment will be described with reference to FIG. 1, FIG. 2 and FIG. 12. FIG. 12 is a block diagram of the stamp device of the described embodiment of the invention. The block diagram of the stamp device comprises a CPU (Central Processing Unit) 201 which functions as a control means, input portion 202, a program ROM (Read Only Memory) 203 which functions as a second memory means, display 204, stepping motor 205 which functions as a driving means, thermal head 206 which functions as a perforating means, a temperature sensor 207 which functions as an environmental temperature detecting means, a CG (Character Generator) ROM 208 which functions as a third storing means, a RAM (Random Access Memory) 209 which functions as a first storing means and a power source 215.

Program ROM 203 stores an operating program for conducting the operation of CPU 201, and a supply time correction table 203A having, for example, three timing values which are used at a low temperature, a normal (intermediate) temperature and a high temperature to be described below. As shown in FIG. 14, in the supply time correction table 203A, the environmental temperature TC of the stamp device is classified into three ranges, that is, a low temperature range TL ($TL<10°$ C.), a normal temperature TM ($10° C. \leqq TM<25°$ C.), and a high temperature range TH ($25° C. \leqq TH$). Supply time correction table 203A stores an energizing time t1, t2 and t3 for thermal head 206 for each of these environmental temperature ranges.

Stepping motor 205 rotates and drives the above-mentioned platen 9. Additionally, stepping motor 205 drives a well-known drive force transmitting device (not shown). The drive force transmitting device comprises a rotation drive portion which receives a drive power from stepping motor 205, and a slip clutch for transmitting the rotation of the rotation drive portion through friction torque to take-up roll 5. The perforated stencil paper 1 is wound up by the take-up roll 5 which is energized in the direction indicated by arrow B in FIG. 2. The speed at which the sheet 1 is fed is controlled by platen 9. When the clutch does not slip, the drive force transmitting device having the above-mentioned construction is set such that the peripheral velocity of take-up roll 5 is usually greater than the peripheral velocity of platen 9. However, the frictional torque of the slip clutch, that is, the tangential power applied by take-up roll 5, is less than the frictional force between stencil paper 1 and platen 9. Therefore, the clutch slips in the range between the maximum peripheral velocity of take-up roll 5 and the peripheral velocity of platen 9. Thus sheet 1 is maintained tightly between platen 9 and take-up roll 5.

Because the construction of the temperature sensor 207 is well-known, and various temperature sensors could be employed, it will not be explained in detail. Temperature sensor 207 detects the environmental temperature of the ink pad 32 and provides the detected temperature information to CPU 201. CPU 201 classifies the detected environmental temperature of the stamp device into three ranges: the low temperature, the normal temperature or the high temperature, according to the temperature information provided by temperature sensor 207. CPU 201 then reads the current supply time (t1, t2 or t3) corresponding to the detected environmental temperature of the stamp device, from supply time correction table 203A stored in program ROM 203. CPU 201 then controls each heat-generating element of the thermal head in accordance with the provided current supply time.

CG ROM 208 stores character patterns which are used for displaying characters on display 204 and for perforating characters in heat sensitive stencil paper 1.

RAM 209 stores the data input from keyboard 202, enables editing of the data to be displayed and to be used in perforation of heat sensitive stencil paper 1.

Power source 215 supplies a direct current to the components of the stamp device. In particular, power source 215 supplies a direct current to thermal head 206 according to instructions provided by CPU 201.

The control operation of thermal head 206 for perforating heat sensitive stencil paper 1 will be explained with reference to FIG. 4–FIG. 8.

Figure 4:
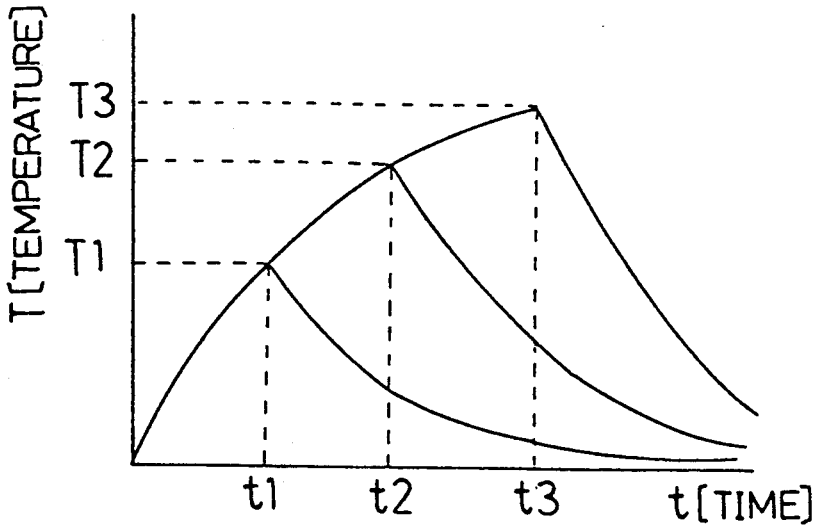
FIG. 4 graphically shows a relationship between a current supply time of current to a thermal head and a temperature of heat generated by the thermal head.
Figure 6:
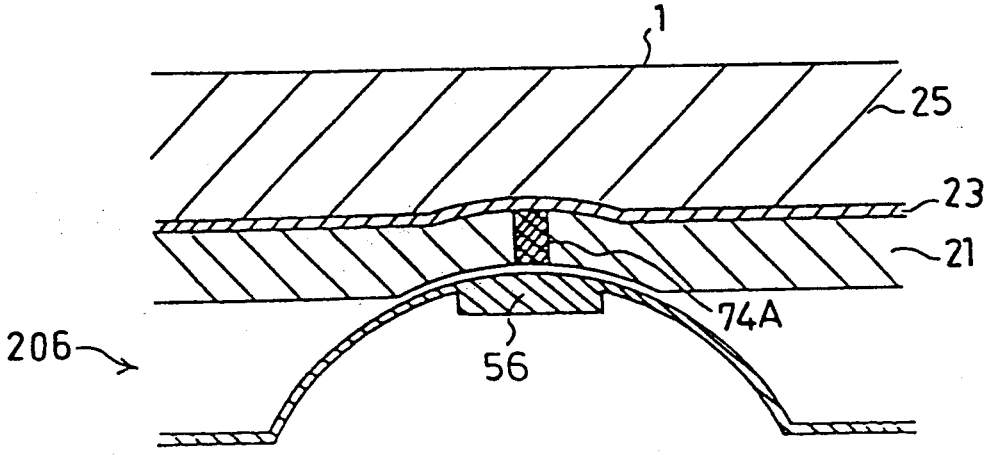
FIG. 6 shows a perforation formed by heat generated by the thermal head when a small amount of energy is applied.

As shown in FIG. 4, the temperature of a heat generating portion 56 of thermal head 206 is controlled by adjusting the current supply time provided to conductors 53A and 53B. When the current supply time to conductors 53A and 53B is t1, the heat generating portion 56 of thermal head 206 generates heat until reaching a temperature T1. When heated to T1, as shown in FIG. 6, a small perforation 74A having a short diameter is formed in thermoplastic film 21 of heat sensitive stencil paper 1.

Figure 7:
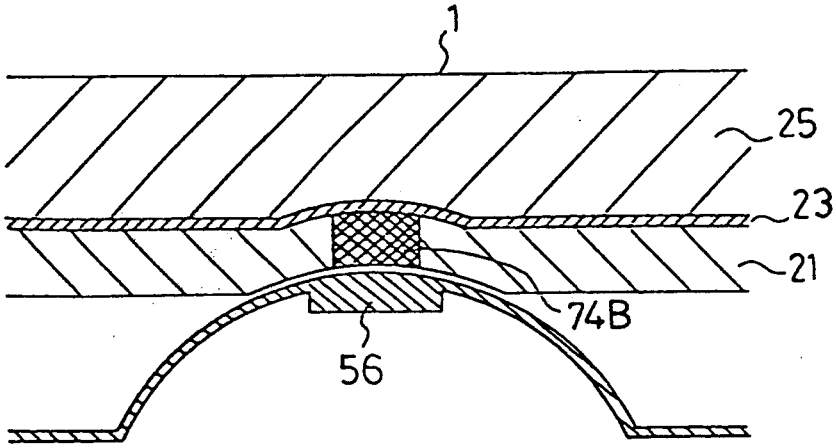
FIG. 7 shows a perforation formed by heat generated by the thermal head when an intermediate amount of energy is applied.

When the current supply time to conductors 53A and 53B is t2 (t1<t2), the heat generating portion 56 of thermal head 206 generates heat until reaching the temperature T2 (T1<T2). When heated to T2, as shown in FIG. 7, an intermediate size perforation 74B is formed in thermoplastic film 21 of heat sensitive stencil paper 1.

Figure 8:
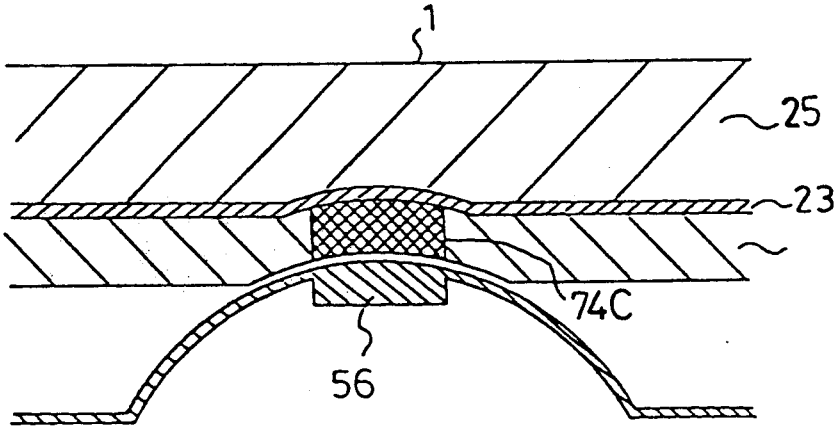
FIG. 8 shows a perforation formed by heat generated by the thermal head when a large amount of energy is applied.

Lastly, when the current supply time to conductors 53A and 53B is t3 (t2<t3), heat generating portion 56 of the thermal head 206 generates heat until reaching the temperature T3 (T2<T3). When heated to T3, as shown in FIG. 8, a large perforation 74C having a large diameter is formed in thermoplastic film 21 of heat sensitive stencil paper 1.

Consequently, the energy provided to thermoplastic film 21 of heat sensitive stencil paper 1 from thermal head 206 can be adjusted by adjusting the current supply time provided to conductors 53A and 53B. The temperature is highest in the center of heat generating portion 56 of the thermal head 206. The temperature is lower toward a peripheral portion of heat generating portion 56. Therefore, with an increase in temperature, the energy applied to the thermoplastic film 21 increases as depicted in FIG. 5. It is understood that the size of the region located beyond a thermoplastic film fusing energy value 73 (shown in FIG. 5) is distributed from the center of the heat generating portion 56, and controls the size of the perforation.

When provided with a small amount of energy 72 (that is, when the current supply time to conductors 53A, 53B is t1), the region of heat generating portion 56 located beyond the thermoplastic film fusing energy value 73 is a small so that a small perforation 74A is formed in the thermoplastic film 21. When provided with an intermediate amount of energy 71 (that is, when the current supply time to conductors 53A, 53B is t2), the region of heat generating portion 56 located beyond the thermoplastic film fusing energy value 73 is such that an intermediate size perforation 74B is formed in the thermoplastic film 21. When provided with a large amount of energy 70 (that is, when the current supply time to conductors 53A, 53B is t3), the region of heat generating portion 56 located beyond the thermoplastic film fusing energy value 73 is a large so that a large perforation 74C is formed in the thermoplastic film 21. Thus, adjustment of the heat energy provided by thermal head 206 (that is, current supply time to conductors 53A, 53B) allows a size of perforations formed on stencil paper 1 to be varied.

Figure 13A:
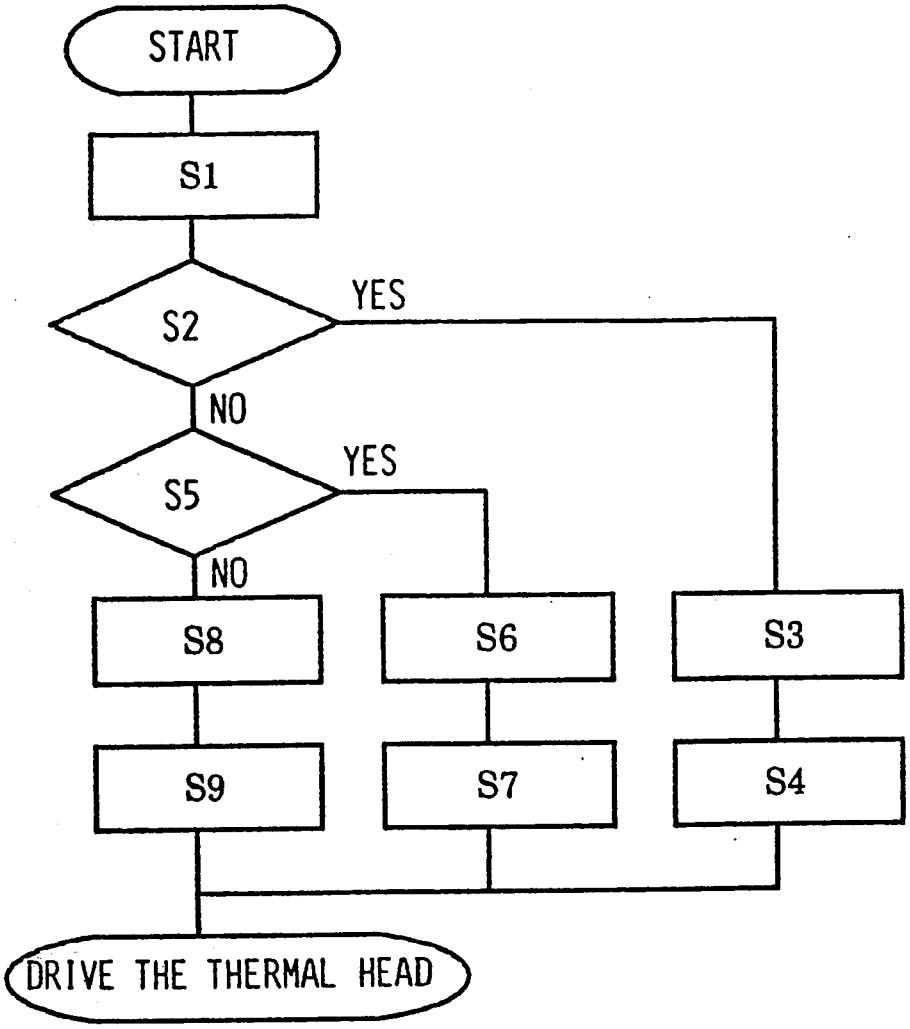
Figure 15:
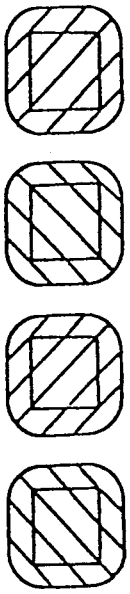
Fig.15 RELATED ART
FIG. 15 is an enlarged view showing spots printed during a low environmental temperature with a conventional stamp device.
Figure 16:
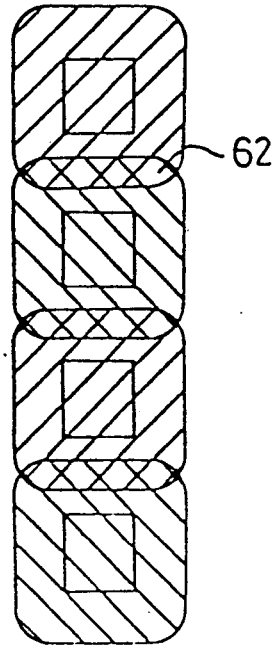
Fig.16 RELATED ART
FIG. 16 is an enlarged view showing spots printed during a high environmental temperature with the conventional stamp device.
Figure 17:
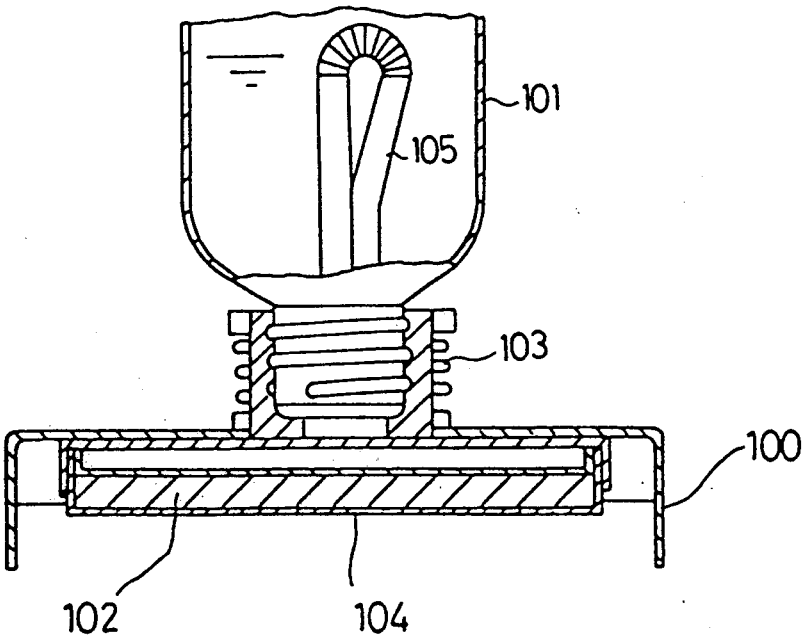
Fig.17 RELATED ART
FIG. 17 is a cross-sectional view of a conventional stamp device.
Figure 18:
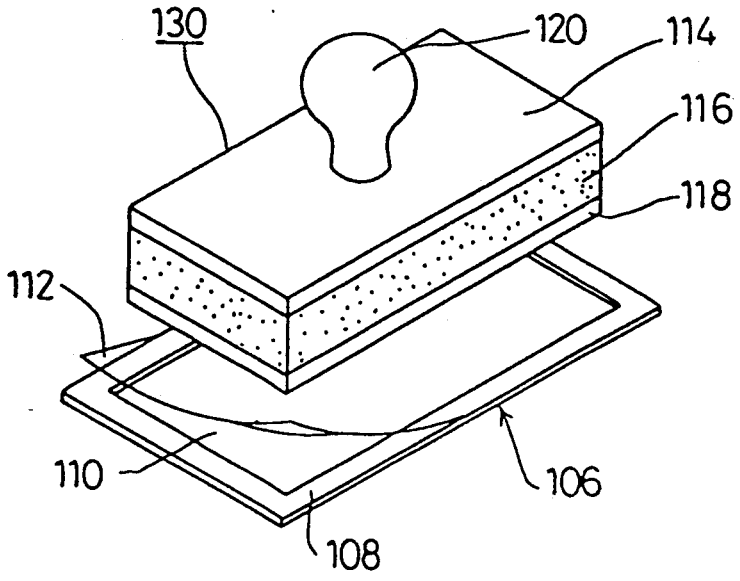
Fig.18 RELATED ART
FIG. 18 is a perspective view of another conventional stamp device.

The operation of the stamp device of the present embodiment will be explained with reference to FIGS. 13A-B. FIGS. 13A-B are a flowchart and table illustrating the operation of the stamp device of the present embodiment. The user pushes power switch 216 of stamp device 200 so that power supply 215 supplies power to stamp device 200. Next, the user inputs desired characters, figures and symbols with keyboard 202. The method of inputting can be as follows. First, the user sets the desired characters, figures and symbols at triangular mark 220 by rotating dial 210, and pressing button 212 which is provided at the center of dial 210. This stores the desired characters, figures and symbols in RAM 209. After input of the characters, figures and symbols, the user operates the conversion key and various function keys 214 so that display 204 displays a format for a sentence and/or design to be perforated in stencil paper 1. When, for example, perforation starting key 218 is pressed, CPU 201 controls temperature sensor 207 such that temperature sensor 207 detects the environmental temperature of stamp device 200, in order to obtain temperature information in Step 1. (Hereafter all steps are referred to with the prefix "S").

According to the temperature information provided by temperature sensor 207, CPU 201 determines whether the environmental temperature TC of stamp device 200 is the low temperature TL (TL<10° C.) in S2. When CPU 201 determines that the environmental temperature TC is the low temperature TL (S2:Yes), CPU 201 selects the current supply time t3 from supply time correction table 203A stored in the program ROM 203 in S3. CPU 201 then sets the current supply time for thermal head 206 to be t3 in S4.

When CPU 201 determines that the environmental temperature TC is not the low temperature TL (S2:No), CPU 201 determines whether the environmental temperature TC is the normal (intermediate) temperature TM (10° C.<TM<25° C.) in S5. When CPU 201 determines that the environmental temperature TC is the normal temperature TM (S5:Yes), CPU 201 selects the current supply time t2 from supply time correction table 203A stored in program ROM 203 in S6. CPU 201 then sets the current supply time for thermal head 206 to be t2 in S7.

When CPU 201 determines that the environmental temperature TC is not the normal temperature TM in S5 (S5:No), CPU 201 determines that the environmental temperature TC is the high temperature TH (25° TH). When CPU 201 determines that the environmental temperature TC is the high temperature TH, CPU 201 selects the current supply time t1 from supply time correction table 203A stored in the program ROM 203 is S8. CPU 201 then sets the current supply time for the thermal head 206 to be t1 in S9.

Thus, CPU 201 sets the current supply time for thermal head 206 to be t1, t2 or t3 according to the environmental temperature TC. Then, when heat sensitive stencil paper 1 is perforated, the thermal head 206 is driven at the set current supply time.

Thus, each time the operator presses the perforation start key 218, CPU appropriately adjusts the current supply time (and thus the perforation size) supplied to the heating elements 56 of thermal head 206. Once the temperature is set, the entire image is printed so that all perforations are formed with a uniform size, optimized for the environmental conditions. If the environmental conditions in which stamp device 200 is being used changes (e.g., changes from a normal temperature to a high or low temperature), the operator presses the perforation start key 218 so that the thermal head 206 is controlled to re-print the image with the appropriate perforation size for the changed environmental conditions.

To perforate heat sensitive stencil paper 1 according to the printing information stored into RAM 209 from input portion 202, the user pushes perforation starting key 218. Then, CPU 201 reads out the printing information stored in RAM 209, and drives thermal head 206 according to that information so that heat sensitive stencil paper is perforated according to the desired printing information. When perforation of heat sensitive stencil paper 1 is completed, the user places stamp device 200 on the medium to be printed 33 and presses down on stamp device 200. Then, the ink from ink storing layer 27 formed inside ink pad 32 is impregnated into porous carrier 25 of heat sensitive paper 1. Consequently, the ink is transferred onto the medium to be printed through the perforations in thermoplastic film 21 of heat sensitive paper 1. Finally, the user removes stamp device 200 from the medium to be printed to complete the print operation.

Figure 9:
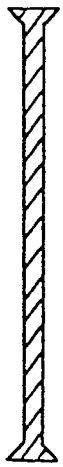
FIG. 9 shows a printed letter "I"
Figure 10:
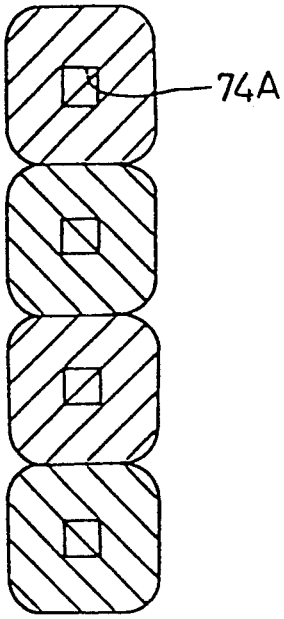
FIG. 10 is an enlarged view showing spots printed at a high environmental temperature according to the present invention.

Assume that a letter "I" shown in FIG. 9 is perforated on the heat sensitive stencil paper 1 in order to print the letter "I". When the environmental temperature TC of stamp device 200 is the high temperature TH, as described above, CPU 201 sets the current supply time to thermal head 206 to be t1. When thermal head 206 is driven at the current supply time t1, the size of perforation 74A is at a minimum as shown in FIG. 10. Because the environmental temperature TC is the high temperature TH, the viscosity of the ink is low, so that the ink can flow easily from the perforation 74A. Thus, when perforation 74A is a small hole, even though the ink more readily flows out from each perforation 74A, the spots do not overlap each other because the small perforations are spaced from each other by a greater distance than the intermediate or large size perforations. Therefore, a high quality print image can be formed.

Figure 11:
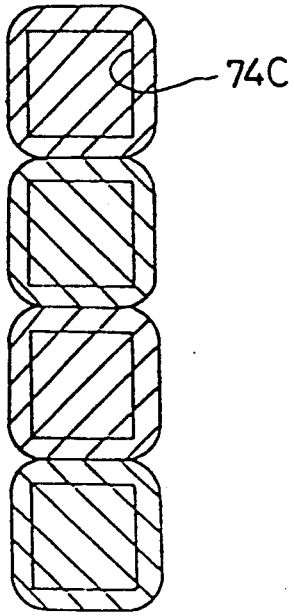
FIG. 11 is an enlarged view showing spots printed at a low environmental temperature according to the present invention.

When the environmental temperature TC of the stamp device 200 is the low temperature TL, as described above, CPU 201 sets the current supply time to the thermal head 206 to be t3. When thermal head 206 is driven at the current supply time t3, the size of perforation 74C is at a maximum as shown in FIG. 11. Because the environmental temperature TC is the low temperature TL, the viscosity of the ink is high, so that the ink does not flow easily from the perforation 74C. Thus, when perforation 74C is a large hole, the spots formed when the ink flows from each perforation 74C are not excessively spaced from each other. Therefore a high quality print image can be formed.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

For example, the shape of the spots formed by thermal head can be a circle or polygon instead of a square.

Moreover, in the above-described embodiment, the environmental temperature is classified into three ranges. However, it is also possible to classify the environmental temperature into a different number of ranges, each with a respective current supply time being stored into the supply time correction table.

Further, the position of the temperature sensor is not limited to the position shown in the above-described figures. The temperature sensor may be disposed at any position where the temperature sensor can detect the temperature of the ink.

Additionally, while the described, preferred embodiment uses a thermal head to perforate a heat sensitive stencil sheet, other means for perforating (such as by punching, cutting, etc.) may be used with different types of stencil sheets.

What is claimed is:

1. A stamp device, comprising:

a stencil paper;

perforating means for forming a perforation pattern of an image on said stencil paper;

temperature detecting means for detecting an environmental temperature of the stamp device and for outputting environmental temperature information; and control means for controlling a size of the perforations which are formed on said stencil paper by said perforating means according to the environmental temperature information output by said temperature detecting means.

2. The stamp device according to claim 1, wherein said stencil paper is a heat sensitive stencil paper.

3. The stamp device according to claim 2, wherein said heat sensitive stencil paper is an elongate web and comprises a thermoplastic film, an adhesive layer and a porous carrier, said adhesive attaching said porous carrier to said thermoplastic film.

4. The stamp device according to claim 3, further comprising:

an inner frame;

a supply roll on which said heat sensitive stencil paper is wound, said supply roll being supported by said inner frame;

a platen for feeding said heat sensitive stencil paper from said supply roll when said perforating means perforates said heat sensitive stencil paper, said platen being supported rotatably by said inner frame;

ink supplying means, located in said inner frame, for supplying ink to said heat sensitive stencil paper after being perforated by said perforating means;

a take-up roll for receiving said heat sensitive stencil paper, said take-up roll being provided rotatably downstream of said ink supplying means, said take-up roll being supported by said inner frame; and drive means, located in said inner frame, for driving said platen and said take-up roll in a predetermined direction.

5. The stamp device according to claim 4, wherein said ink supplying means comprises an ink pad and an ink storing layer provided in said ink pad.

6. The stamp device according to claim 4, further comprising:

input means for inputting an image to be perforated on said heat sensitive stencil paper;

first storing means for storing the image input from said input means;

display means for displaying the image input from said input means; and a power source for supplying a direct current to the stamp device.

7. The stamp device according to claim 6, wherein said input means comprises:

a dial operable to select a character to be input; and a button operable to store the selected character to said first storing means, said button being provided at a center of said dial.

8. The stamp device according to claim 6, wherein said perforating means comprises a thermal head, wherein said control means controls a current supply time of the direct current from said power source to said thermal head according to the environmental temperature information output from said temperature detecting means.

9. The stamp device according to claim 8, further comprising second storing means for storing a plurality of current supply time periods for said thermal head in correspondence with a plurality of environmental temperature information ranges capable of being output by said temperature detecting means;

wherein said control means reads a current supply time period from said second storing means according to the environmental temperature information output by said temperature detecting means, and drives said thermal head according to the current supply time period.

10. A stamp device, comprising:

a heat sensitive stencil paper;

a thermal head which forms a perforation pattern of an image on said heat sensitive stencil paper;

first storing means for storing the image to be perforated on said heat sensitive stencil paper by said thermal head;

temperature detecting means for detecting an environmental temperature of the stamp device and for outputting environmental temperature information;

second storing means for storing a plurality of current supply time periods for said thermal head corresponding to plural different environmental temperature ranges; and control means for reading the image from said first storing means and a current supply time period of said thermal head from said second storing means according to the environmental temperature information output by said temperature detecting means, and for controlling a size of the perforations which are formed on said heat sensitive stencil paper by said thermal head according to the current supply time period read from said second storing means, and for driving said thermal head to perforate the image on said heat sensitive stencil paper.

11. The stamp device according to claim 10, wherein said heat sensitive stencil paper is a web and comprises a thermoplastic film, an adhesive layer and a porous carrier, said adhesive layer attaching said porous carrier to said thermoplastic film.

12. The stamp device according to claim 11, further comprising:

an inner frame;

a supply roll on which said heat sensitive stencil paper is wound, said supply roll being supported by said inner frame;

a platen for feeding said heat sensitive stencil paper from said supply roll when said perforating means perforates said heat sensitive stencil paper, said platen being supported rotatably by said inner frame;

ink supplying means, located in said inner frame, for supplying ink to said heat sensitive stencil paper after being perforated by said perforating means;

a take-up roll for receiving said heat sensitive stencil paper, said take-up roll being provided rotatably on a downstream side of said ink supplying means, said take-up roll being supported by said inner frame; and drive means, located in said inner frame, for driving said platen and said take-up roll in a predetermined direction.

13. The stamp device according to claim 12, further comprising:

input means for inputting an image to be perforated on said heat sensitive stencil paper;

first storing means for storing the image input from said input means;

display means for displaying the image input from said input means; and a power source for supplying a direct current to the stamp device.

14. The stamp device according to claim 13, wherein said input means comprises:

a dial for selecting the image to be input;

a button for defining and storing the image selected by said dial into said first storing means, said button being provided at a center of said dial; and a plurality of keys for designating a plurality of functions.

15. A stamp device, comprising:

a heat sensitive stencil paper;

input means for inputting an image to be perforated on said heat sensitive stencil paper;

first storing means for storing the image input from said input means;

display means for displaying the image input from said input means;

feeding means for feeding said heat sensitive stencil paper;

a thermal head which forms a perforation pattern of the image on said heat sensitive stencil paper fed by said feeding means;

a temperature detecting sensor for detecting an environmental temperature of the stamp device;

a power source for supplying a direct current to the stamp device;

second storing means for storing a plurality of current supply time periods of said power source to said thermal head in correspondence with a plurality of environmental temperature ranges which can be detected by said temperature detecting sensor; and control means for reading the image stored in said first storing means and the current supply time period of said thermal head from said second storing means according to the environmental temperature detected by said temperature detecting sensor, and for controlling a size of the perforations which are formed on said heat sensitive stencil paper by said thermal head according to the current supply time read from said second storing means, and for driving said thermal head to perforate the image on said heat sensitive stencil paper.

16. The stamp device according to claim 15, wherein said heat sensitive stencil paper is a web and comprises a thermoplastic film, an adhesive layer and a porous carrier, said adhesive layer attaching said porous carrier to said thermoplastic film.

17. The stamp device according to claim 16, further comprising:

an inner frame;

a supply roll on which said heat sensitive stencil paper is wound, said supply roll being supported by said inner frame;

ink supplying means, located in said inner frame, for supplying ink to said heat sensitive stencil paper after being perforated by said perforating means;

and wherein said feeding means comprises:

a platen for feeding said heat sensitive stencil paper from said supply roll when said perforating means is perforating said heat sensitive stencil paper, said platen being supported rotatably by said inner frame;

a take-up roll for receiving said heat sensitive stencil paper, said take-up roll being provided rotatably downstream of said ink supplying means, said take-up roll being supported by said inner frame; and drive means, located in said inner frame, for driving said platen and said take-up roll in a predetermined direction.

18. The stamp device according to claim 15, wherein said input means comprises:

a dial operable to select the image to be input; and a button operable to store the selected image in said first storing means, said button being provided at a center of said dial.

19. A stamp device, comprising:

a stencil paper;

perforating means for forming a perforation pattern of an image on said stencil paper;

means for providing size information relating to a size of perforations to be formed by said perforation means including:

a temperature detector for detecting a temperature of ink to be used with said stamp device; and a storing means for storing said size information for forming different sized perforations, said size information being stored in said storing means in correspondence with a plurality of different temperature ranges capable of being detected by said temperature detector; and control means for controlling said perforating means according to said size information.

20. The stamp device according to claim 19, wherein said stencil paper is a heat sensitive stencil paper.

21. A stamp device for forming a desired image with ink, comprising:

a stencil paper;

perforating means for forming a perforation pattern of the image on said stencil paper;

means for providing state information relating to a state of viscosity of the ink to be used with the stamp device; and control means for controlling a size of the perforations which are formed on said stencil paper by said perforating means according to the state information.

* * * * *